US008708836B1

(12) United States Patent
Ehlers et al.

(10) Patent No.: US 8,708,836 B1
(45) Date of Patent: Apr. 29, 2014

(54) GOLF CLUB HEAD WITH IMPROVED AERODYNAMIC CHARACTERISTICS

(75) Inventors: Steven M. Ehlers, Poway, CA (US); D. Clayton Evans, San Marcos, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 319 days.

(21) Appl. No.: 13/220,519

(22) Filed: Aug. 29, 2011

Related U.S. Application Data

(60) Provisional application No. 61/378,340, filed on Aug. 30, 2010, provisional application No. 61/378,343, filed on Aug. 30, 2010, provisional application No. 61/378,502, filed on Aug. 31, 2010, provisional application No. 61/378,635, filed on Aug. 31, 2010, provisional application No. 61/379,039, filed on Sep. 1, 2010, provisional application No. 61/379,449, filed on Sep. 2, 2010, provisional application No. 61/380,007, filed on Sep. 3, 2010.

(51) Int. Cl.
*A63B 53/02* (2006.01)

(52) U.S. Cl.
USPC ..... 473/309; 473/310; 473/314; 473/305

(58) Field of Classification Search
USPC ..... 473/309, 310, 314, 308, 307, 305, 317
See application file for complete search history.

(56) References Cited

U.S. PATENT DOCUMENTS

| | | | | |
|---|---|---|---|---|
| 1,587,758 | A | | 6/1926 | Charavay |
| D118,594 | S | | 1/1940 | Heddon |
| 3,595,577 | A | | 7/1971 | Hodge |
| 4,065,133 | A | | 12/1977 | Gordos |
| 4,856,782 | A | * | 8/1989 | Cannan ..... 473/232 |
| 4,930,783 | A | | 6/1990 | Antonious |
| 5,120,061 | A | | 6/1992 | Tsuchida et al. |
| 5,163,682 | A | | 11/1992 | Schmidt et al. |
| 5,203,565 | A | | 4/1993 | Murray et al. |
| 5,251,896 | A | | 10/1993 | Gerlach |
| 5,318,297 | A | | 6/1994 | Davis et al. |
| 5,318,300 | A | | 6/1994 | Schmidt et al. |
| 5,335,908 | A | | 8/1994 | Bamber |
| 5,474,296 | A | | 12/1995 | Schmidt et al. |
| 5,542,666 | A | * | 8/1996 | Chou ..... 473/314 |
| 5,575,725 | A | | 11/1996 | Olsavsky |
| 5,674,136 | A | | 10/1997 | Gorse et al. |
| 5,803,824 | A | * | 9/1998 | Rollingson ..... 473/246 |
| 5,830,084 | A | | 11/1998 | Kosmatka |
| D401,991 | S | | 12/1998 | Collins |
| 5,873,793 | A | | 2/1999 | Swinford |
| 5,921,870 | A | | 7/1999 | Chiasson |
| 5,938,541 | A | | 8/1999 | Allen et al. |

(Continued)

*Primary Examiner* — Benjamin Layno
(74) *Attorney, Agent, or Firm* — Rebecca Hanovice; Michael A. Catania; Sonia Lari

(57) ABSTRACT

A golf club head (40) with a face component (50), an aft body (70), and an aerodynamic hosel (50) is disclosed herein. The hosel (50) has one or more joints (80, 85, 87) around which pieces or segments of the hosel (50) may be rotated or pivoted to modify the way in which a shaft is oriented with respect to the club head (40) when the hosel (50) is rigidly affixed to the club head (40). The present invention may be used to modify the loft, lie, and/or face angle parameters of the golf club head.

8 Claims, 10 Drawing Sheets

(56) References Cited

U.S. PATENT DOCUMENTS

| | | | | |
|---|---|---|---|---|
| 5,961,397 | A | 10/1999 | Lu et al. | |
| 5,971,868 | A | 10/1999 | Kosmatka | |
| 6,007,432 | A | 12/1999 | Kosmatka | |
| 6,027,414 | A | 2/2000 | Koebler | |
| 6,048,278 | A | 4/2000 | Meyer et al. | |
| 6,095,929 | A * | 8/2000 | Clark | 473/248 |
| 6,244,976 | B1 | 6/2001 | Murphy et al. | |
| 6,287,215 | B1 * | 9/2001 | Fisher | 473/309 |
| 6,332,847 | B2 | 12/2001 | Murphy et al. | |
| 6,338,683 | B1 | 1/2002 | Kosmatka | |
| 6,354,962 | B1 | 3/2002 | Galloway et al. | |
| 6,368,234 | B1 | 4/2002 | Galloway et al. | |
| 6,386,990 | B1 | 5/2002 | Reyes et al. | |
| 6,398,666 | B1 | 6/2002 | Evans et al. | |
| 6,406,378 | B1 | 6/2002 | Murphy et al. | |
| 6,413,169 | B1 | 7/2002 | Kosmatka et al. | |
| 6,428,426 | B1 | 8/2002 | Helmstetter et al. | |
| 6,435,977 | B1 | 8/2002 | Helmstetter et al. | |
| 6,440,008 | B2 | 8/2002 | Murphy et al. | |
| 6,471,604 | B2 | 10/2002 | Hocknell et al. | |
| 6,478,692 | B2 | 11/2002 | Kosmatka | |
| 6,491,592 | B2 | 12/2002 | Cackett et al. | |
| 6,508,978 | B1 | 1/2003 | Deshmukh | |
| 6,527,650 | B2 | 3/2003 | Reyes et al. | |
| 6,561,922 | B2 | 5/2003 | Bamber | |
| 6,565,452 | B2 | 5/2003 | Helmstetter et al. | |
| 6,575,845 | B2 | 6/2003 | Galloway et al. | |
| 6,582,323 | B2 | 6/2003 | Soracco et al. | |
| 6,592,466 | B2 | 7/2003 | Helmstetter et al. | |
| 6,602,149 | B1 | 8/2003 | Jacobson | |
| 6,607,452 | B2 | 8/2003 | Helmstetter et al. | |
| 6,612,398 | B1 | 9/2003 | Tokimatsu et al. | |
| 6,623,377 | B2 | 9/2003 | Evans et al. | |
| 6,663,504 | B2 | 12/2003 | Hocknell et al. | |
| 6,669,578 | B1 | 12/2003 | Evans | |
| 6,739,982 | B2 | 5/2004 | Helmstetter et al. | |
| 6,758,763 | B2 | 7/2004 | Murphy et al. | |
| 6,860,824 | B2 | 3/2005 | Evans | |
| 6,994,637 | B2 | 2/2006 | Murphy et al. | |
| 6,997,821 | B2 | 2/2006 | Galloway et al. | |
| 7,014,570 | B2 | 3/2006 | Evans et al. | |
| 7,025,692 | B2 | 4/2006 | Erickson et al. | |
| 7,070,517 | B2 | 7/2006 | Cackett et al. | |
| 7,101,289 | B2 | 9/2006 | Gibbs et al. | |
| 7,112,148 | B2 | 9/2006 | Deshmukh | |
| 7,118,495 | B2 | 10/2006 | Sullivan et al. | |
| 7,121,957 | B2 | 10/2006 | Hocknell et al. | |
| 7,125,344 | B2 | 10/2006 | Hocknell et al. | |
| 7,128,661 | B2 | 10/2006 | Soracco et al. | |
| 7,137,907 | B2 | 11/2006 | Gibbs et al. | |
| 7,144,334 | B2 | 12/2006 | Ehlers et al. | |
| 7,163,463 | B2 * | 1/2007 | Mills | 473/244 |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,169,060 | B2 | 1/2007 | Stevens et al. | |
| 7,214,143 | B2 | 5/2007 | Deshmukh | |
| 7,226,366 | B2 | 6/2007 | Galloway | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,278,927 | B2 | 10/2007 | Gibbs et al. | |
| 7,291,075 | B2 | 11/2007 | Williams et al. | |
| 7,306,527 | B2 | 12/2007 | Williams et al. | |
| 7,311,613 | B2 | 12/2007 | Stevens et al. | |
| 7,314,418 | B2 | 1/2008 | Galloway et al. | |
| 7,320,646 | B2 | 1/2008 | Galloway | |
| 7,387,577 | B2 | 6/2008 | Murphy et al. | |
| 7,390,269 | B2 | 6/2008 | Williams et al. | |
| 7,396,296 | B2 | 7/2008 | Evans | |
| 7,402,112 | B2 | 7/2008 | Galloway | |
| 7,407,448 | B2 | 8/2008 | Stevens et al. | |
| 7,410,428 | B1 | 8/2008 | Dawson et al. | |
| 7,413,519 | B1 | 8/2008 | Dawson et al. | |
| 7,413,520 | B1 | 8/2008 | Hocknell et al. | |
| 7,419,440 | B2 | 9/2008 | Williams et al. | |
| 7,431,667 | B2 | 10/2008 | Vincent et al. | |
| 7,438,647 | B1 | 10/2008 | Hocknell | |
| 7,448,960 | B2 | 11/2008 | Gibbs et al. | |
| 7,455,598 | B2 | 11/2008 | Williams et al. | |
| 7,476,161 | B2 | 1/2009 | Williams et al. | |
| 7,491,134 | B2 | 2/2009 | Murphy et al. | |
| 7,494,424 | B2 | 2/2009 | Williams et al. | |
| 7,497,787 | B2 | 3/2009 | Murphy et al. | |
| 7,549,935 | B2 | 6/2009 | Foster et al. | |
| 7,578,751 | B2 | 8/2009 | Williams et al. | |
| 7,588,501 | B2 | 9/2009 | Williams et al. | |
| 7,591,737 | B2 | 9/2009 | Gibbs et al. | |
| 7,717,807 | B2 | 5/2010 | Evans et al. | |
| 7,749,096 | B2 | 7/2010 | Gibbs et al. | |
| 7,749,097 | B2 | 7/2010 | Foster et al. | |
| D629,475 | S | 12/2010 | Rollinson | |
| D630,690 | S | 1/2011 | Rollinson | |
| 8,177,659 | B1 * | 5/2012 | Ehlers | 473/305 |
| 2005/0032584 | A1 | 2/2005 | Van Nimwegen | |
| 2009/0318245 | A1 | 12/2009 | Yim et al. | |
| 2010/0009771 | A1 | 1/2010 | Newcomer | |
| 2010/0016095 | A1 | 1/2010 | Burnett et al. | |
| 2010/0016096 | A1 | 1/2010 | Burnett et al. | |
| 2010/0016097 | A1 | 1/2010 | Albertsen et al. | |
| 2010/0178997 | A1 | 7/2010 | Gibbs et al. | |
| 2010/0292020 | A1 | 11/2010 | Tavares et al. | |
| 2010/0311517 | A1 | 12/2010 | Tavares et al. | |
| 2011/0136584 | A1 | 6/2011 | Boyd et al. | |

* cited by examiner

FIG. 6A
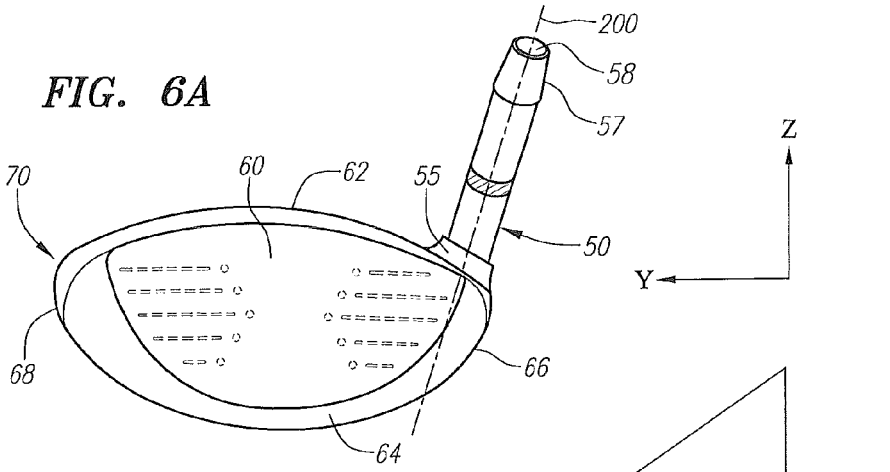
FIG. 6B
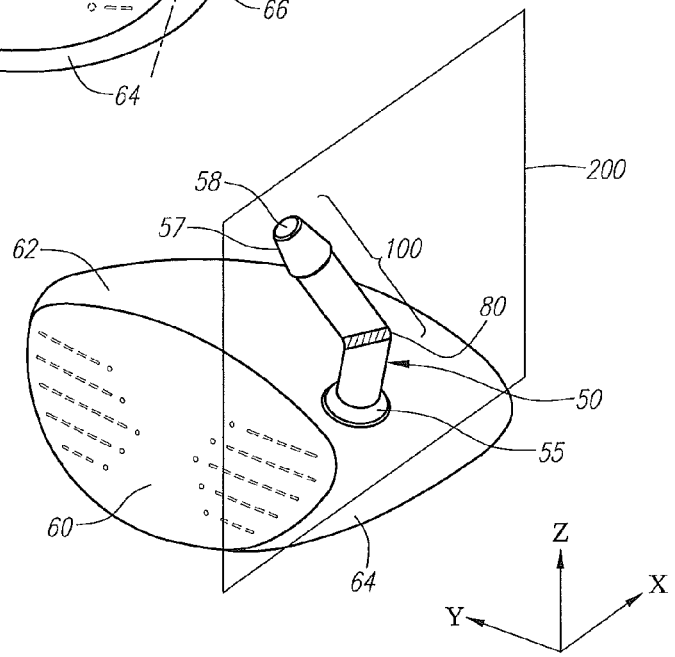
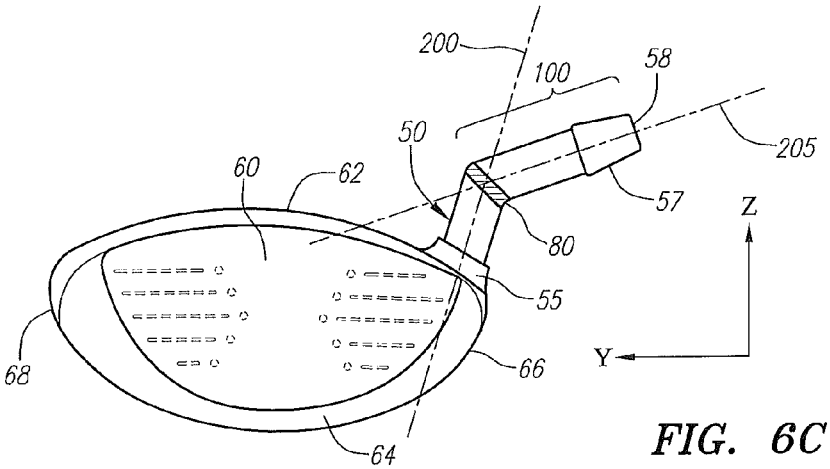
FIG. 6C

GOLF CLUB HEAD WITH IMPROVED AERODYNAMIC CHARACTERISTICS

CROSS REFERENCES TO RELATED APPLICATIONS

The present application claims priority to U.S. Provisional Patent Application No. 61/378,340, filed on Aug. 30, 2010, U.S. Provisional Patent Application No. 61/378,343, filed on Aug. 30, 2010, U.S. Provisional Patent Application No. 61/378,502, filed on Aug. 31, 2010, U.S. Provisional Patent Application No. 61/378,635, filed on Aug. 31, 2010, U.S. Provisional Patent Application No. 61/379,039, filed on Sep. 1, 2010, U.S. Provisional Patent Application No. 61/379,449, filed on Sep. 2, 2010, and U.S. Provisional Patent Application No. 61/380,007, filed on Sep. 3, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a hosel configuration that improves the aerodynamic qualities of the golf club head. More specifically, the present invention relates to wood-type golf club heads. Even more specifically, the present invention relates to drivers.

2. Description of the Related Art

Technical innovation in the configuration, material, construction and performance of golf clubs has resulted in a variety of new products. The advent of metals as a structural material has largely replaced natural wood for wood-type golf club heads, and is but one example of this technical innovation resulting in a major change in the golf industry. Another important example is the use of composite or plastic materials to form components of golf club heads, including the face, crown, and/or sole.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. According to the Rules, the shaft of a golf club must be attached to a wood club head at the club head heel either directly or through a single plain neck and/or socket. The length from the top of the neck and/or socket to the sole of the club must not exceed 5 inches (127 mm), measured along the axis of, and following any bend in, the neck and/or socket.

Although the prior art has disclosed many variations of golf club heads, the prior art has failed to provide a club head with a hosel configuration that does not interfere with or have a negative affect on airflow over the crown of the club head during a swing.

BRIEF SUMMARY OF THE INVENTION

The inventors have found that, by moving the connection point between the hosel and the club head further away from the face of the club head in comparison with prior art hosel configurations, the hosel has less opportunity to create undesired air flow interference with an airstream as it moves over and around the crown of the club head during a swing. In order to have optimal head and face alignment with the ball during set up, address, and impact, however, it is desirable to design the club head so that a shaft axis remains close to the face and is biased towards the heel.

The present invention provides a solution to this problem by including a hosel configuration that has an optimal shaft axis location and an optimal hosel connection point such that the air flow interference can be reduced without negatively affecting the alignment of the club head with a golf ball. More specifically, a hosel of the present invention has portions that are semi-permanently affixed to one another to modify the way that the shaft and club head are oriented with respect to one another when the hosel is rigidly affixed to the club head. This configuration may be used to modify the loft, lie, and/or face angle parameters of the golf club head as desired by the golfer.

One aspect of the present invention is a golf club head comprising a face component, a crown, a sole, and a hosel comprising a shaft connection portion, a head connection portion, and a first joint located between the shaft connection portion and the head connection portion, wherein the first joint allows the shaft connection portion to rotate with respect to the head connection portion. In a further embodiment, the golf club head includes an intermediate segment and a second joint, wherein the second joint is disposed between the head connection portion and the shaft connection portion and is spaced from the first joint, and wherein the intermediate segment is located between the first and second joints. In a further embodiment of the present invention, the first and second joints allow the intermediate segment to rotate with respect to the head connection portion and the shaft connection portion.

Another aspect of the present invention is a golf club head comprising a face component, a crown, a sole, and a hosel comprising a head connection portion, a shaft connection portion, and at least one movable segment, wherein the movable segment is located between the shaft connection portion and the head connection portion. In further embodiments of the invention, the movable segment is pivotally attached to the shaft connection portion, the head connection portion, or both the shaft connection portion and the head connection portion. In a further embodiment of the invention, the golf club head further comprises a second movable segment located between the first movable segment and the head connection portion. In yet a further embodiment, the first movable segment is pivotally attached to the second movable segment. In another embodiment of the invention, the golf club head further comprises a second movable segment located between the first movable segment and the shaft connection portion. In yet a further embodiment of the invention, the first movable segment is pivotally attached to the second movable segment.

Yet another aspect of the present invention is a golf club head comprising a face component, a crown, a sole, and a hosel comprising a removable shaft connection portion and a head connection portion.

Another aspect of the present invention is a golf club head comprising a face component, a crown, a sole, and a hosel comprising a shaft connection portion, a head connection portion, and an intermediate segment located between the shaft connection portion and the head connection portion, wherein at least one of the intermediate segment, the shaft connection portion, and the head connection portion are removable.

BRIEF DESCRIPTION OF THE SEVERAL VIEWS OF THE DRAWINGS

FIG. 6A is a front perspective view of the golf club head shown in FIG. 2C.

FIG. 6B is a side perspective view of the golf club head shown in FIG. 6A.

FIG. 6C is a front perspective view of a golf club head according to a twelfth embodiment of the present invention.

DETAILED DESCRIPTION OF THE INVENTION

The present invention is generally directed to a golf club head with a novel hosel configuration that creates reduced interference with airflow over the crown of the club head during a swing in comparison with hosel configurations of the prior art. In some embodiments of the present invention, the golf club head is a wood, e.g., a driver, fairway wood, or hybrid club.

Figure 1A:
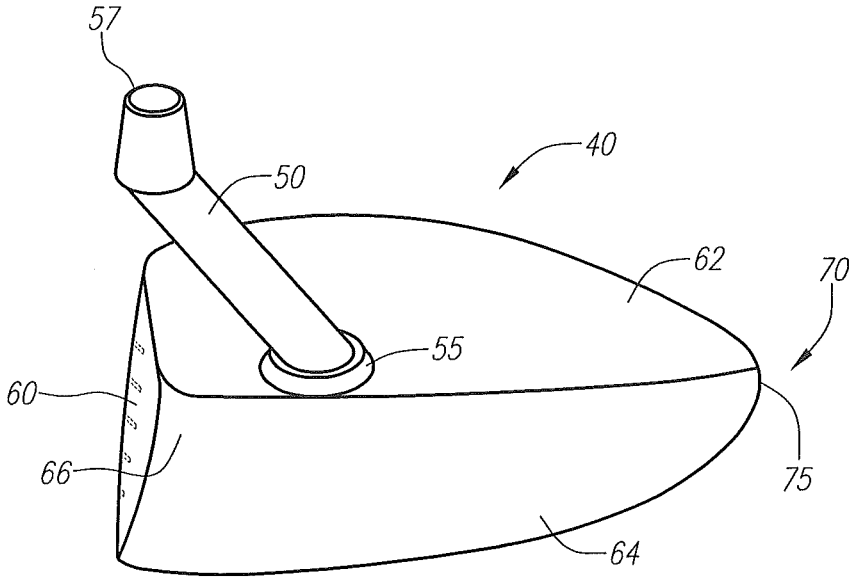
FIG. 1A is a side perspective view of a golf club head according to an embodiment of the present invention.
Figure 1B:
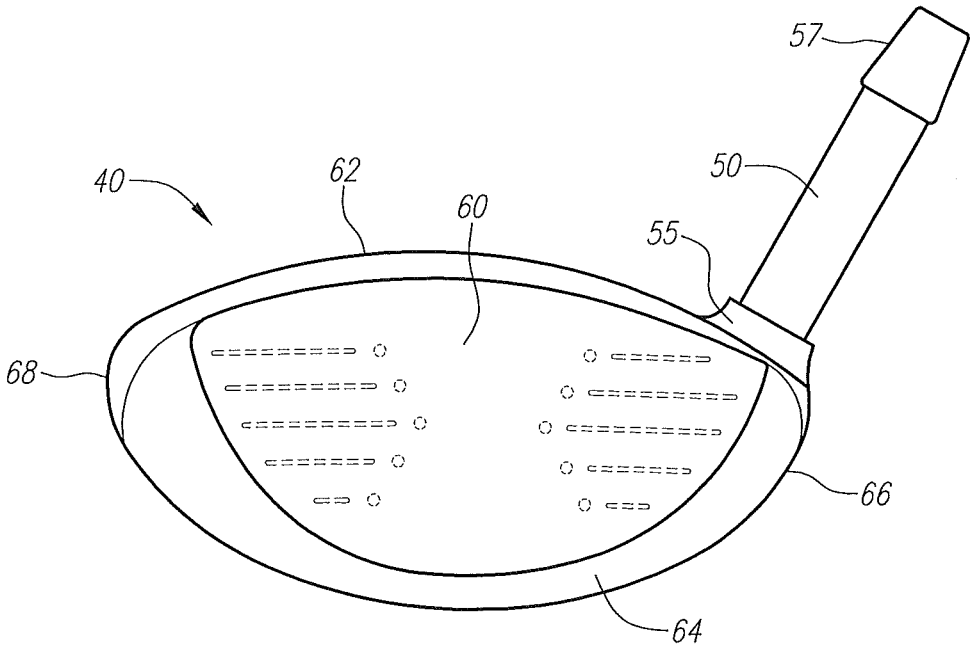
FIG. 1B is a front perspective view of the golf club head shown in FIG. 1A.

As shown in FIGS. 1A and 1B, a golf club head 40 is generally designated. The golf club head 40 may have a hollow interior (not shown). As shown in FIGS. 1A and 1B, the club head 40 is generally composed of a face 60, an aft body 70 comprising a crown 62 and a sole 64, and a hosel 50. In this embodiment, the hosel is swept back and straight. The club head 40 also may optionally have a ribbon, skirt, or side portion (not shown) disposed between the crown 62 and sole 64 portions. The golf club head 40 is preferably partitioned into a heel section 66 nearest the shaft hosel 50, a toe section 68 opposite the heel section 66, and a rear section 75 opposite the face component 60. The hosel 50 is connected to the club head 40 at a head connection portion 55 and to a shaft (not shown) at a shaft connection portion 57. The hosel 50 of this embodiment does not comprise any movable or removable parts.

Figure 2A:
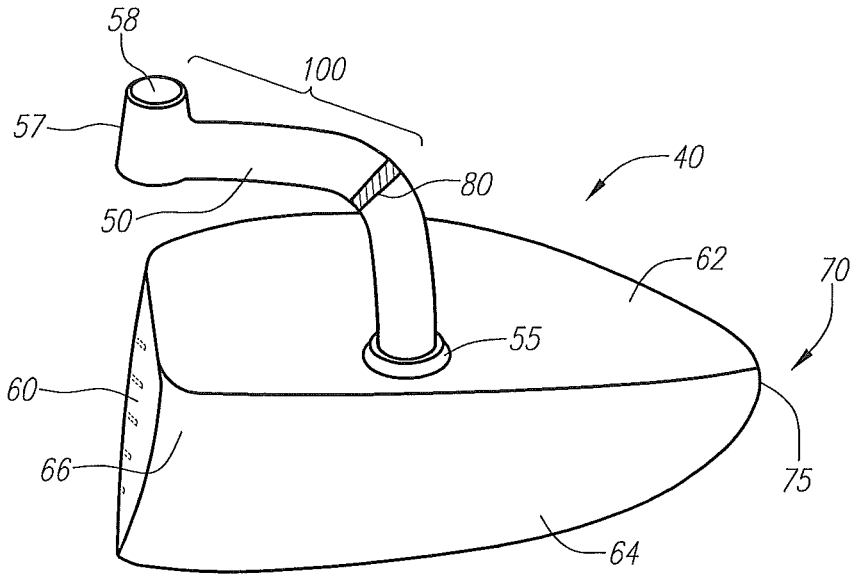
FIG. 2A is a side perspective view of a golf club head according to a second embodiment of the present invention.

FIG. 2A shows a preferred embodiment of the present invention. The hosel 50 of FIG. 2A has a single, curved, concave bend with a joint 80 at the midpoint of the bend. The shaft connection portion 57 of the hosel 50 of this embodiment, which in this embodiment is equivalent to a whole upper segment 100 extending between the joint 80 and an opening that receives the shaft 58, may be pivoted or rotated about the joint 80 to modify the way the shaft and club head 40 are oriented with respect to one another. In a further embodiment, the upper segment 100 may be removed from the joint 80 and an alternative upper segment 100 may be substituted and attached to the club head 40 at the joint 80 for customization of the hosel 50. In these embodiments the upper segment 100 is not permanently affixed to the head connection portion 55 of the hosel 50.

Figure 2B:
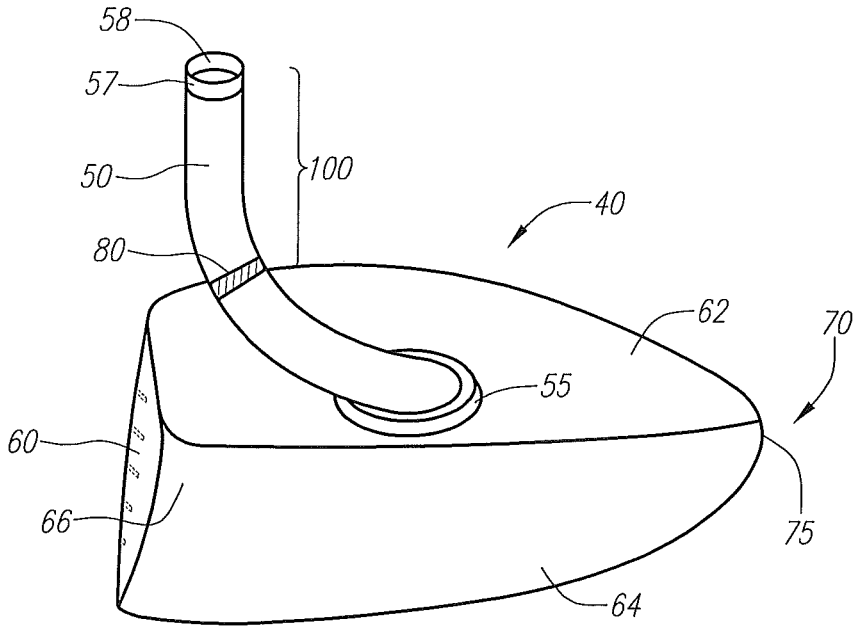
FIG. 2B is a side perspective view of a golf club head according to a third embodiment of the present invention.

FIG. 2B shows an alternative embodiment of the present invention. The hosel 50 of FIG. 2B has a single, convex bend with a joint 80 at the midpoint of the bend. The shaft connection portion 57 of the hosel 50 of this embodiment, which in this embodiment is equivalent to a whole upper segment 100 extending between the joint 80 and an opening that receives the shaft 58, may be pivoted or rotated about the joint 80 to modify the way the shaft and club head 40 are oriented with respect to one another. In a further embodiment, the upper segment 100 may be removed from the joint 80 and an alternative upper segment 100 may be substituted and attached to the club head 40 at the joint 80 for customization of the hosel 50. In these embodiments the upper segment 100 is not permanently affixed to the head connection portion 55 of the hosel 50.

Figure 2C:
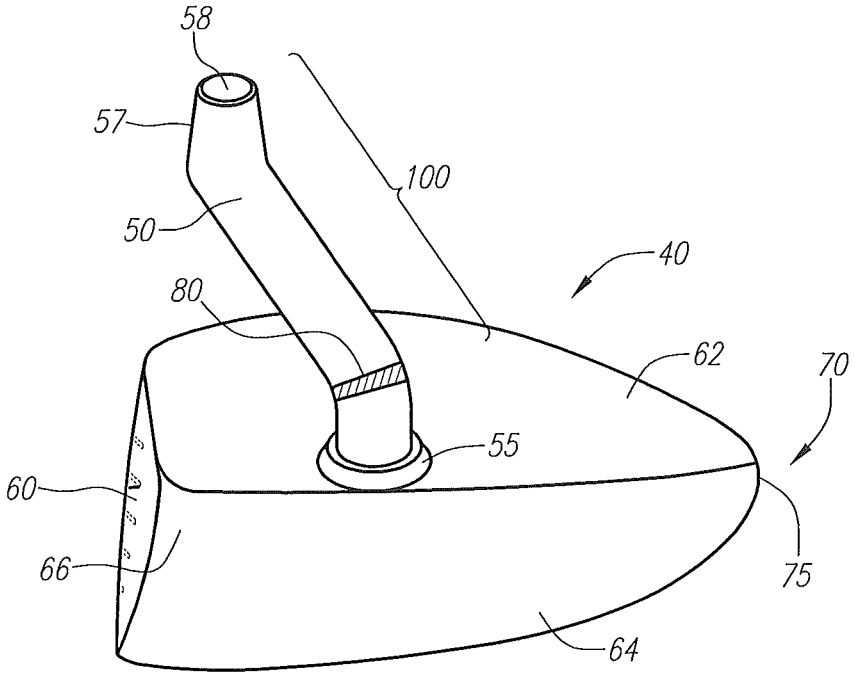
FIG. 2C is a side perspective view of a golf club head according to a fourth embodiment of the present invention.

FIG. 2C shows an alternative embodiment of the present invention. The hosel 50 of FIG. 2C has a single, angled bend with a joint 80 disposed in the angled bend where the head connection portion 55 connects with a shaft connection portion 57, which in this embodiment is equivalent to a whole upper segment 100 extending between the joint 80 and an opening that receives the shaft 58. The upper segment 100 may be pivoted or rotated about the joint 80 to modify the way the shaft and club head 40 are oriented with respect to one another. In a further embodiment, the upper segment 100 may be removed from the joint 80 and an alternative upper segment 100 may be substituted and attached to the club head 40 at the joint 80 for customization of the hosel 50. In these embodiments the upper segment 100 is not permanently affixed to the head connection portion 55 of the hosel 50.

Figure 2D:
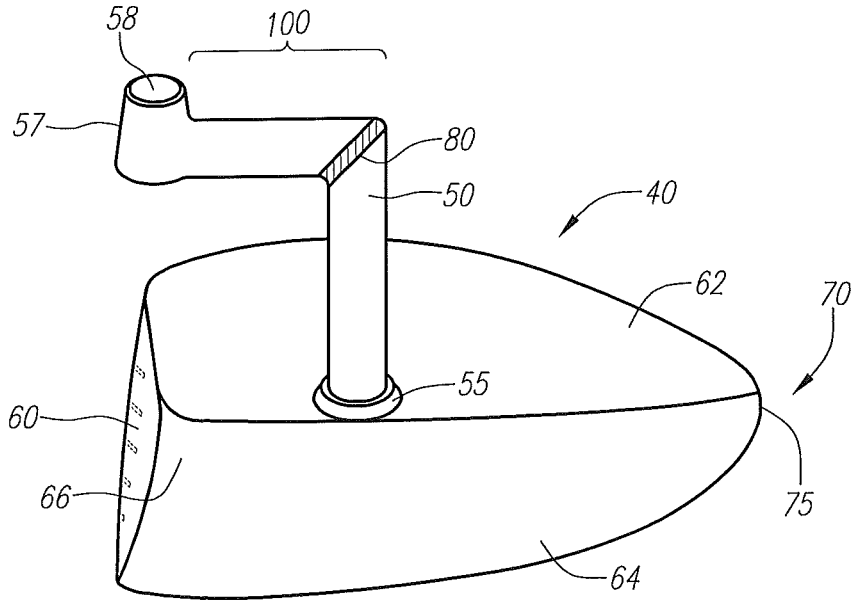
FIG. 2D is a side perspective view of a golf club head according to a fifth embodiment of the present invention.

FIG. 2D shows an alternative embodiment of the present invention. The hosel 50 of FIG. 2C has a single, approximately ninety-degree angle bend with a joint 80 disposed in the angled bend where the head connection portion 55 connects with a shaft connection portion 57, which in this embodiment is equivalent to a whole upper segment 100 extending between the joint 80 and an opening that receives the shaft 58. The upper segment 100 may be pivoted or rotated about the joint 80 to modify the way the shaft and club head 40 are oriented with respect to one another. In a further embodiment, the upper segment 100 may be removed from the joint 80 and an alternative upper segment 100 may be substituted and attached to the club head 40 at the joint 80 for customization of the hosel 50. In these embodiments the upper segment 100 is not permanently affixed to the head connection portion 55 of the hosel 50.

Figure 3A:
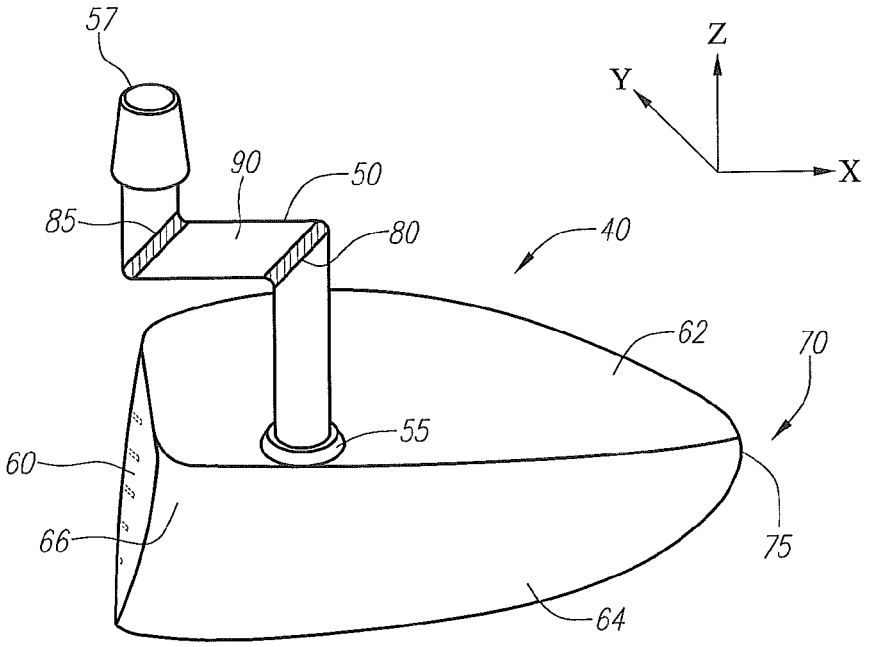
FIG. 3A is a side perspective view of a golf club head according to a sixth embodiment of the present invention.

FIG. 3A shows another embodiment of the present invention. The hosel 50 of FIG. 3A has two, approximately ninety-degree angle bends, each bend having a joint 80, 85, and a straight intermediate segment 90 rotatably connected to the head connection portion 55 at the first joint 80 and the shaft connection portion 57 at the second joint 85.

Figure 3B:
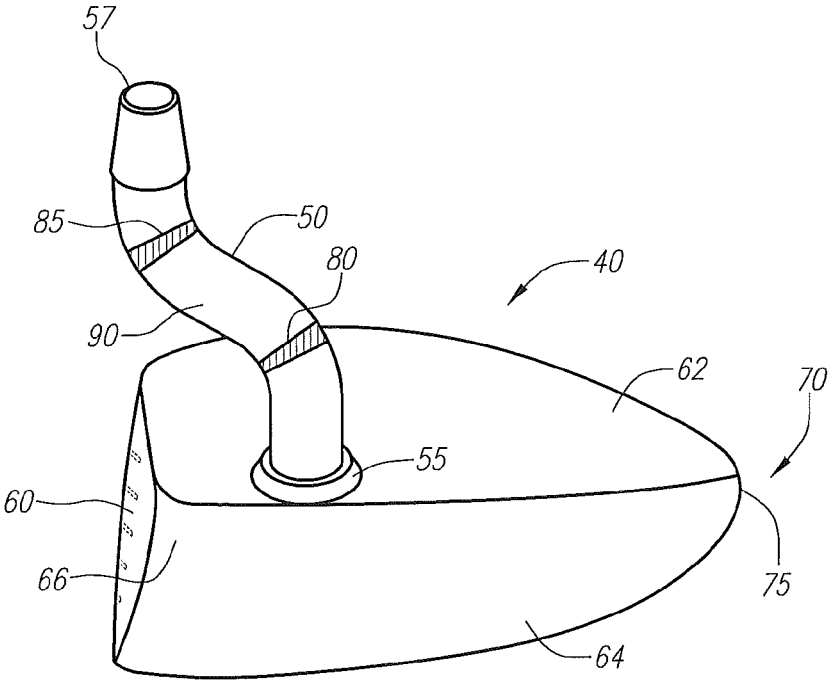
FIG. 3B is a side perspective view of a golf club head according to a seventh embodiment of the present invention.

FIG. 3B shows another embodiment of the present invention, wherein the hosel 50 has two curved bends, each bend having a joint 80, 85, and a curved (or straight, in another embodiment) intermediate section 90 rotatably connected to the head connection portion 55 at the first joint and the shaft connection portion 57 at the second joint 85.

Figure 3C:
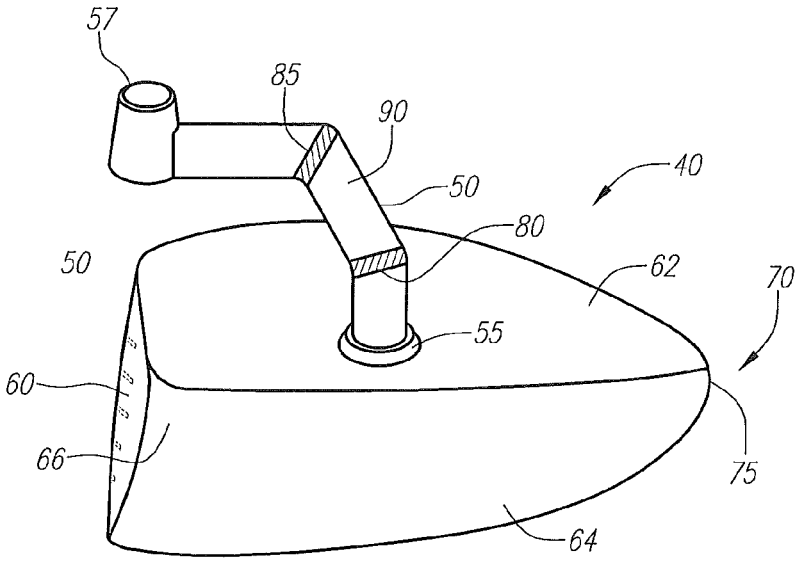
FIG. 3C is a side perspective view of a golf club head according to an eighth embodiment of the present invention.

FIG. 3C shows another embodiment of the present invention, wherein the hosel 50 has two, non-ninety-degree angle bends, each bend having a joint 80, 85, and a straight intermediate segment 90 rotatably connected to the head connection portion 55 at the first joint 80 and the shaft connection portion 57 at the second joint 85.

Figure 3D:
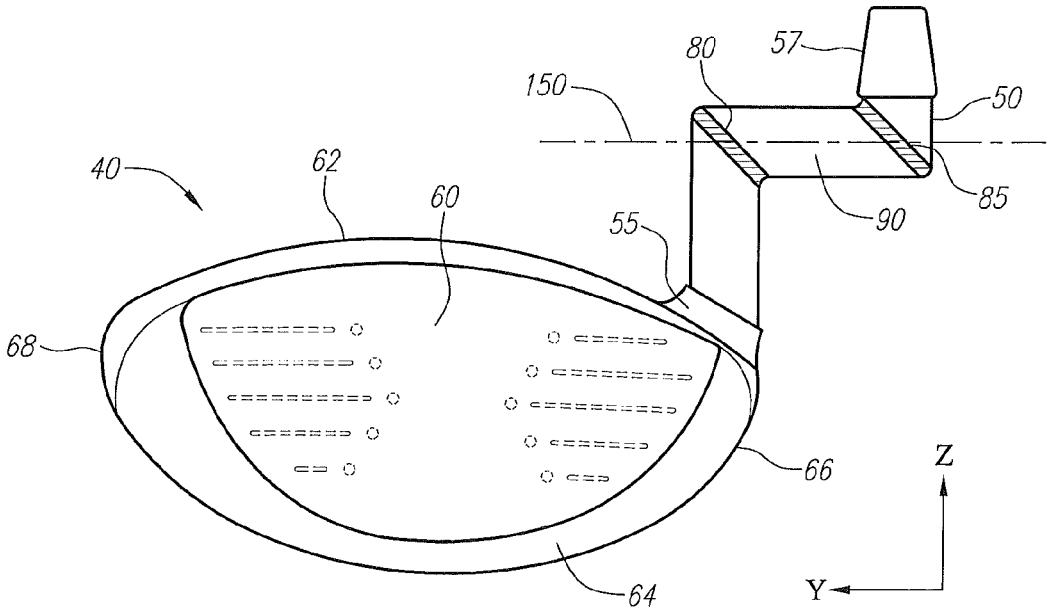
FIG. 3D is a front perspective view of a golf club head according to a ninth embodiment of the present invention.

FIG. 3D shows another embodiment of the present invention, wherein the hosel 50 has two, approximately ninety-degree angle bends, each bend having a joint 80, 85, and a straight intermediate segment 90 rotatably connected to the head connection portion 55 at the first joint 80 and the shaft connection portion 57 at the second joint 85. The embodiment shown in FIG. 3A may have the conformation shown in FIG. 3D if the intermediate segment 90 of FIG. 3A is rotated around the first joint 80 of the hosel 50 such that an axis 150 of the intermediate segment 90 is substantially parallel to a y-axis, which is a horizontal axis extending from the heel section 66 of the club head 40 to the toe section 68 of the club head.

The intermediate segment 90 and the shaft connection portion 57 of each of the hosels shown in FIGS. 3A-3D may be pivoted or rotated about the joints 80, 85 to modify the way in which the shaft and club head 40 are oriented with respect to one another. In further embodiments, the shaft connection portion 57 and/or the intermediate segment 90 may be removed from the joints 80, 85 and alternative pieces may be substituted and attached to head connection portion 55 at the joints 80, 85 for customization of the hosel 50. In these embodiments, the shaft connection portion 57 and/or the intermediate segment 90 are not permanently affixed to the head connection portion 55 of the hosel 50.

Figure 4A:
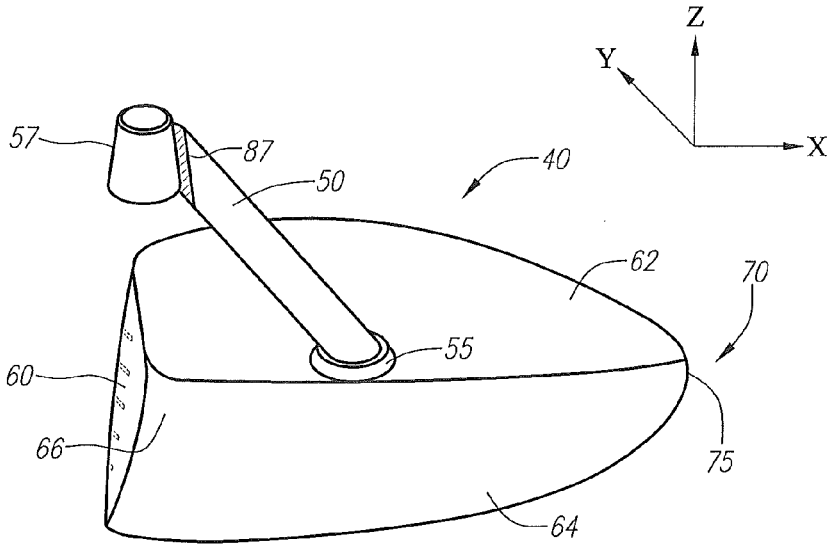
FIG. 4A is a side perspective view of a golf club head according to a tenth embodiment of the present invention.
Figure 4B:
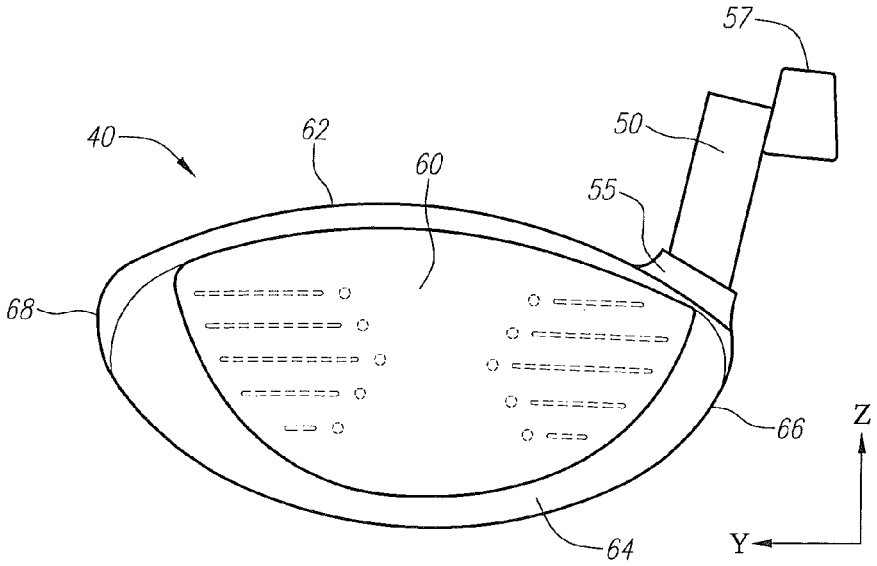
FIG. 4B is a front perspective view of the golf club head shown in FIG. 4A.

FIGS. 4A and 4B show an alternative embodiment of the present invention. The hosel 50 of this embodiment is swept back and straight, with a shaft connection portion 57 and a head connection portion 55. The head connection portion 55 of this embodiment may refer to the entire length of the hosel 50 up to but not including the shaft connection portion 57. The shaft connection portion 57 is offset along a y-axis, as shown in FIG. 4B, and is movably fixed to the head connection portion 55 at a joint 87 located at the top of the head connection portion 55 of the hosel 50. The orientation of the shaft with respect to the golf club head 40 may be altered by rotating the shaft connection portion 57 around the joint 87. In other embodiments, the shaft connection portion is not permanently affixed to the head connection portion 55 at the joint 87 and thus may be removed and replaced with other pieces for customization of the hosel 50.

Figure 5A:
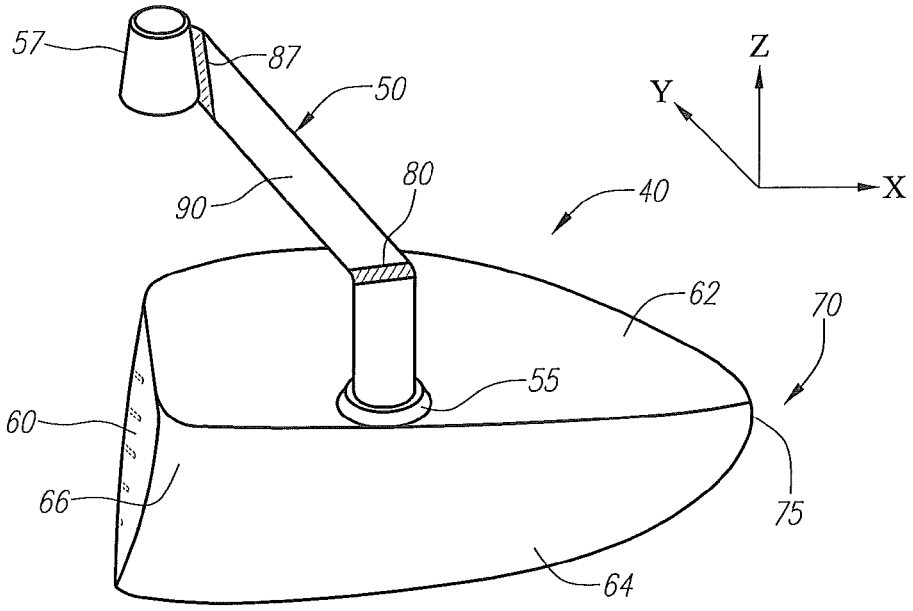
FIG. 5A is a side perspective view of a golf club head according to an eleventh embodiment of the present invention.
Figure 5B:
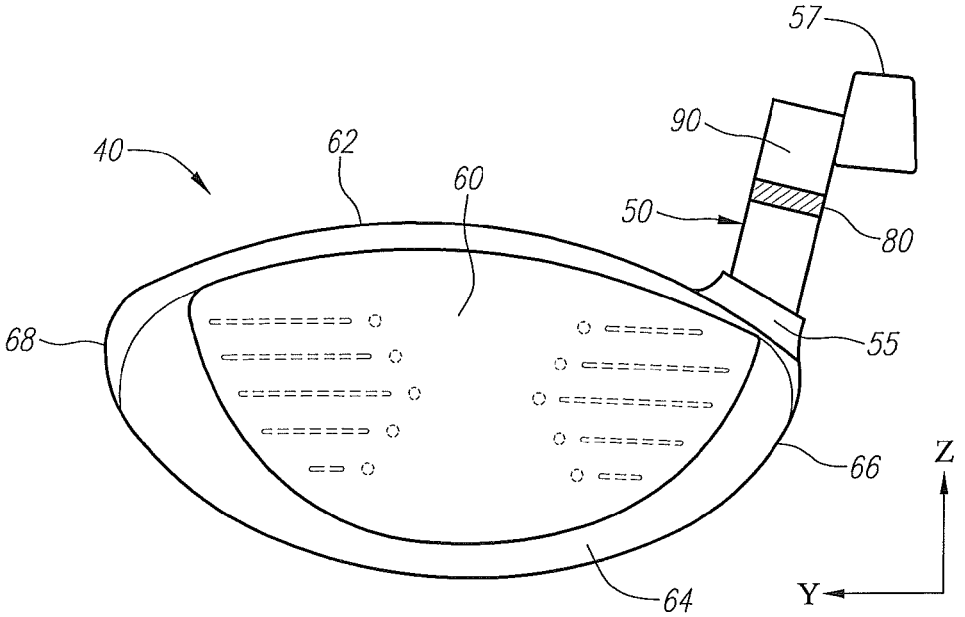
FIG. 5B is a front perspective view of the golf club head shown in FIG. 5A.

FIGS. 5A and 5B show yet another embodiment of the present invention. The hosel 50 of this embodiment is swept back and straight and includes one, non-ninety-degree angle bend having a joint 80 between the shaft connection portion 57 and the head connection portion 55. The hosel 50 further includes an intermediate segment 90 located between the joint 80 and the shaft connection portion 57. The shaft connection portion 57 is offset along a y-axis, as shown in FIG. 5B, and is movably fixed to the intermediate segment 90 at a joint 87 located at the top of the intermediate segment 90. The orientation of the shaft with respect to the golf club head 40 may be altered by rotating the shaft connection portion 57 around the joint 87 and by rotating the intermediate segment 90 around one or both of the joints 80, 87. In other embodiments, the shaft connection portion 57 and/or the intermediate segment 90 is not permanently affixed to the head connection portion 55 at the joints 80, 87 and thus may be removed and replaced with other pieces for customization of the hosel 50.

The various hosel 50 pieces of the embodiments of the present invention may or may not lie along the same plane, and may be non-planar or non-parallel to one another. FIGS. 6A and 6B show front and side perspective views of a hosel 50 configuration wherein all pieces of the hosel 50, including an upper segment 100 including the shaft connection portion 57 and the head connection portion 55, are aligned along one XZ plane 200. By rotating the upper segment 100 around the joint 80, as shown in FIG. 6C, the upper segment 100 no longer aligns with the XZ plane 200, but instead lies along a different plane 205 that intersects the XZ plane 200.

Figure 7A:
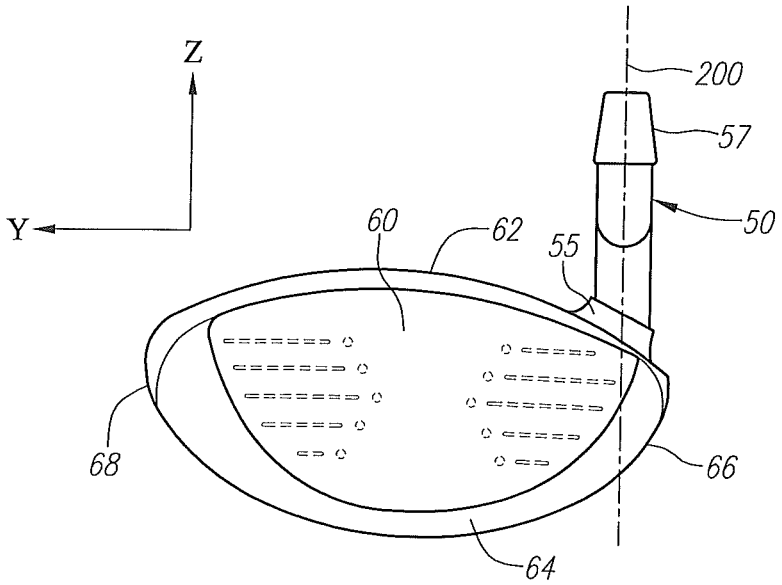
FIG. 7A is a front perspective view of the golf club head shown in FIG. 3A.
Figure 7B:
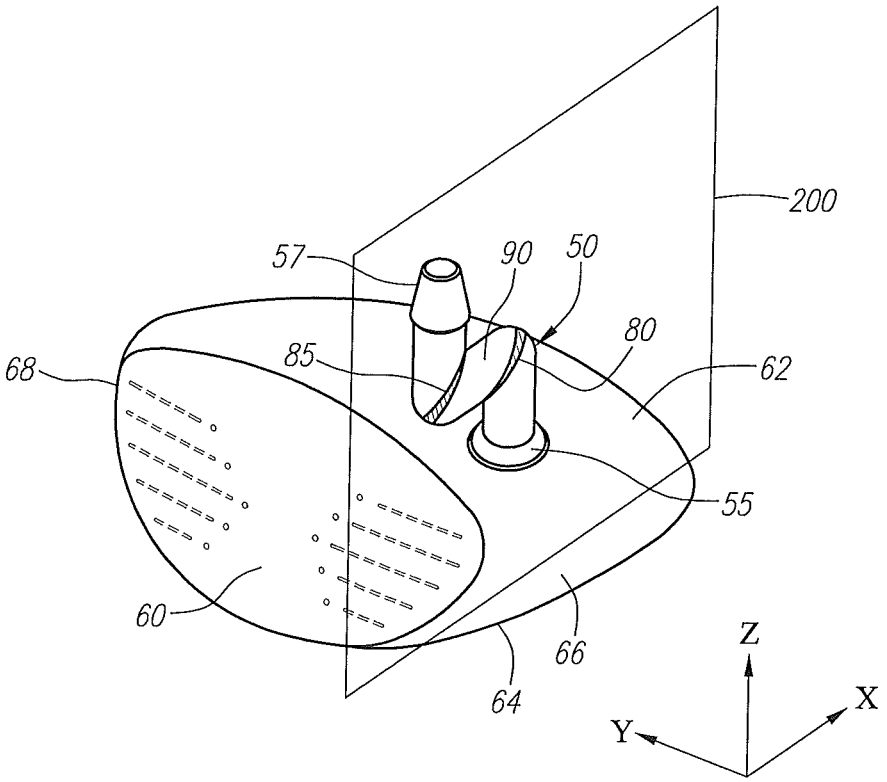
FIG. 7B is a side perspective view of the golf club head shown in FIG. 7A.
Figure 7C:
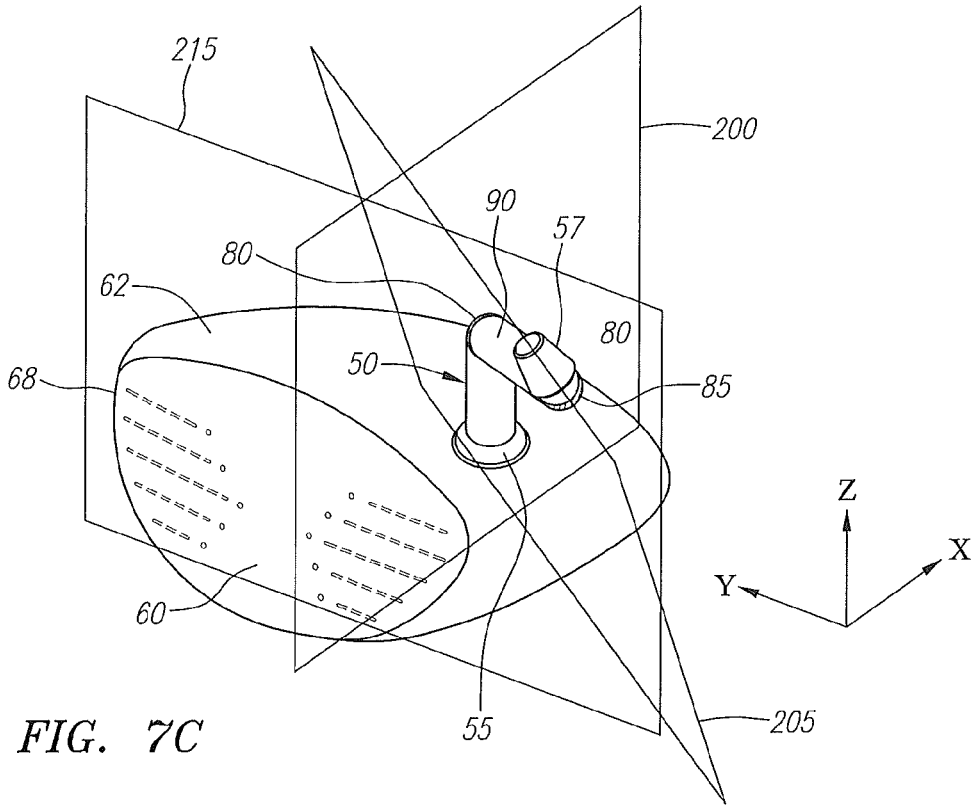
FIG. 7C is a side perspective view of a golf club head according to a thirteenth embodiment of the present invention.
Figure 7D:
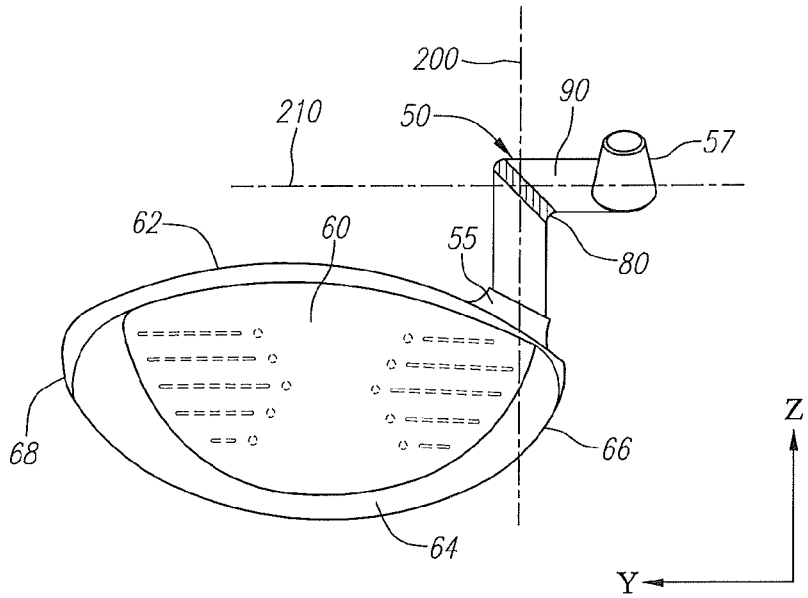
FIG. 7D is a front perspective view of the golf club head of FIG. 7C.

The non-planar alignment of hosel 50 pieces is also shown in FIGS. 7C-7D. FIGS. 7A and 7B show front and side perspective views of a hosel 50 configuration wherein all pieces of the hosel 50, including the head connection portion 55, the intermediate segment 90, and the shaft connection portion 57, are aligned along one XZ plane 200. By rotating the shaft connection portion 57 around joint 85, as shown in FIG. 7C, the shaft connection portion no longer aligns with the XZ plane 200, but instead lies along a different plane 205 that intersects the XZ plane 200. The intermediate segment 90 may also be rotated around joint 80 so that its axis 210 lies along a plane 215 that intersects the XZ plane 200, as shown in FIGS. 7C and 7D.

In some embodiments of the present invention, the cross-sectional shape of one or more segments or pieces of the hosel of may be circular, elliptical, airfoil, symmetrical, or non-uniform to encourage aerodynamic airflow around, over, across, and by the hosel during a swing. Furthermore, the diameters or thicknesses of pieces or segments of the hosel of the present invention may, in some embodiments, vary and/or taper to help reduce the drag of air around, over, across, and by the hosel during a swing. Lengths of pieces or segments of the hosel also may vary. For example, in an embodiment wherein a segment of the hosel has an airfoil cross-section, that segment preferably has a length of 0.25 to 1.50 inch, and more preferably a length of no more than 1.00 inch.

The hosel of the present invention may be permanently and rigidly affixed to the golf club head, or may be semi-permanently and rigidly affixed, such that the hosel may be adjustably attached to the golf club head to customize the loft, lie, and face angles of the club head for a golfer wishing to alter these variables to his or her liking. In one embodiment, the hosel of the present invention is attached to the club head by affixing it to a spud shaft that is permanently and rigidly affixed to the club head for the express purpose of positioning, locating, and rigidly affixing the hosel in a desired orientation on the club head. In another embodiment, the hosel design of the present invention may be attached to the club head by affixing it into a receiving cavity or a receiving mating location that is designed into the club head for the express purpose of positioning, locating, and rigidly affixing the hosel in a desired orientation onto the club head.

The golf club head of the present invention may be made from various materials, including, but not limited to, titanium and titanium alloys, magnesium, aluminum, tungsten, carbon or graphite composite, plastic, stainless steel, etc. In some embodiments, the entire club head is made of one material. In other embodiments, the club head is made of two or more materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face component, a crown, and a sole; and a hosel comprising a shaft connection portion, a head connection portion, a first joint located between the shaft connection portion and the head connection portion, an intermediate segment, and a second joint disposed between the intermediate segment and the shaft connection portion, wherein the intermediate segment is located between the first and second joints, wherein the first joint allows the shaft connection portion and the intermediate segment to rotate with respect to the head connection portion, and wherein the second joint is spaced from the first joint and allows the shaft connection portion to rotate with respect to, and independently of, the intermediate segment and the head connection portion.

2. The golf club head of claim 1, wherein a cross-sectional shape of the hosel is selected from a group consisting of circular, elliptical, airfoil symmetrical, and non-uniform.

3. The golf club head of claim 2, wherein at least part of the hosel has an airfoil cross-sectional shape.

4. The golf club head of claim 3, wherein the part of the hosel having an airfoil cross-sectional shape has a length of 0.25 to 1.50 inches.

5. The golf club head of claim 4, wherein the part of the hosel having an airfoil cross-sectional shape has a length that is less than or equal to 1.00 inch.

6. A golf club head comprising:

a face component, a crown, and a sole; and a hosel comprising a head connection portion, a shaft connection portion, a first movable segment, and a second movable segment, wherein the first movable segment is located between the shaft connection portion and the head connection portion, wherein the second movable segment is located between the first movable segment and the head connection portion, and wherein the entire first movable segment comprises a convex curvature.

7. The golf club head of claim 6, wherein the first movable segment is pivotally attached to the shaft connection portion.

8. The golf club head of claim 6, wherein the first movable segment is pivotally attached to the second movable segment.

* * * * *